US009580987B2

(12) United States Patent
Liotta et al.

(10) Patent No.: US 9,580,987 B2
(45) Date of Patent: Feb. 28, 2017

(54) SPHERICAL BLOWOUT PREVENTER WITH ENERGIZEABLE PACKER SEAL AND METHOD OF USING SAME

(71) Applicant: National Oilwell Varco, L.P., Houston, TX (US)

(72) Inventors: Joseph James Liotta, Conroe, TX (US); Eric Trevor Ensley, Cypress, TX (US); Christopher Dale Johnson, Cypress, TX (US)

(73) Assignee: National Oilwell Varco, L.P., Houston, TX (US)

( * ) Notice: Subject to any disclaimer, the term of this patent is extended or adjusted under 35 U.S.C. 154(b) by 372 days.

(21) Appl. No.: 14/229,268

(22) Filed: Mar. 28, 2014

(65) Prior Publication Data

US 2015/0275609 A1 Oct. 1, 2015

(51) Int. Cl.
*E21B 33/06* (2006.01)
*E21B 33/04* (2006.01)
*E21B 33/064* (2006.01)

(52) U.S. Cl.
CPC ..... *E21B 33/06* (2013.01); *E21B 33/0422* (2013.01); *E21B 33/064* (2013.01)

(58) Field of Classification Search
CPC ..... E21B 33/06; E21B 33/064; E21B 33/0422
USPC ..... 166/85.4; 251/1.1, 1.2; 277/324, 327
See application file for complete search history.

(56) References Cited

U.S. PATENT DOCUMENTS 2,731,281 A 1/1956 Knox
3,449,993 A 6/1969 Temple et al.
3,667,721 A * 6/1972 Vujasinovic ..... E21B 33/06 251/1.1
4,283,039 A 8/1981 Schaeper et al.
4,537,250 A 8/1985 Troxell, Jr.
4,858,882 A * 8/1989 Beard ..... E21B 33/06 251/1.2
4,949,785 A 8/1990 Beard et al.
5,116,017 A * 5/1992 Granger ..... E21B 33/06 251/1.2
5,178,215 A 1/1993 Yenulis et al.
5,588,491 A 12/1996 Brugman et al.
5,662,171 A 9/1997 Brugman et al.
(Continued)

OTHER PUBLICATIONS

PCT International Search Report and Written Opinion dated Sep. 11, 2015 for counterpart PCT Application No. PCT/US2015/022847, 10 pages.

*Primary Examiner* — George Gray
(74) *Attorney, Agent, or Firm* — Conley Rose, P.C.

(57) ABSTRACT

A blowout preventer includes a housing having a flow path therethrough in fluid communication with a wellbore penetrating a subsurface formation and a sealing assembly positionable in the housing about the flow path. The sealing assembly includes a piston slidably positionable in the housing and a packer element. The packer element includes a plurality of fingers and a packer seal. The fingers include a housing portion and a piston portion. The housing portion is slidably movable along the housing and the piston portion is slidingly movable along the piston. The fingers are engageable by the piston and movable to a sealed position about the flow path, and the packer seal is energized to form a seal about the blowout preventer to seal the wellbore in the subsurface formation.

32 Claims, 10 Drawing Sheets

(56) References Cited

U.S. PATENT DOCUMENTS

| | | | | |
|---|---|---|---|---|
| 6,016,880 | A | 1/2000 | Hall et al. | |
| 8,424,607 | B2 | 4/2013 | Springett et al. | |
| 2002/0100589 | A1* | 8/2002 | Childers | E21B 33/0355 166/339 |
| 2014/0048731 | A1* | 2/2014 | Leuchtenberg | E21B 33/06 251/1.1 |

* cited by examiner

SPHERICAL BLOWOUT PREVENTER WITH ENERGIZEABLE PACKER SEAL AND METHOD OF USING SAME

BACKGROUND

The present disclosure relates generally to techniques for performing wellsite operations. More specifically, the present invention relates to techniques, such as sealing and/or severing a tubular at the wellsite, for preventing blowouts.

Oilfield operations may be performed to locate and gather valuable downhole fluids. Oil rigs are positioned at wellsites, and downhole tools, such as drilling tools, are deployed into the ground to reach subsurface reservoirs. Once the downhole tools form a wellbore (or borehole) to reach a desired reservoir, casings may be cemented into place within the wellbore, and the wellbore completed to initiate production of fluids from the reservoir. Tubulars may be positioned in the wellbore to enable the passage of subsurface fluids to the surface.

Leakage of subsurface fluids may pose an environmental threat if released from the wellbore. Equipment, such as blow out preventers (BOPs), may be positioned about the wellbore to form a seal about a wellbore to prevent leakage of fluid therefrom. Various types of BOPs, such as ram, spherical, annular, etc., may be used. For example, BOPs may have rams with blades to sever and/or seal the wellbore, or employ a spherical configuration. Some examples of BOPs are provided in U.S. Pat. Nos. 5,588,491 and 5,662,171, the entire contents of which are hereby incorporated by reference herein.

SUMMARY

In at least one aspect, the disclosure relates to a seal assembly of a blowout preventer for sealing a wellbore penetrating a subsurface formation. The blowout preventer has a housing with a fluid path therethrough in fluid communication with the wellbore. The seal assembly includes a piston slidably positionable in the housing and a packer element. The piston has a hole therethrough in fluid communication with the fluid path. The packer element includes a plurality of fingers and a packer seal. Each of the fingers includes a housing portion and a piston portion. The housing portion is slidably movable along the housing and the piston portion slidingly movable along the piston. The fingers are engageable by the piston and movable to a sealed position about the flow path whereby the packer seal is selectively energizable to form a seal about the blowout preventer.

The housing portion may be pivotally connectable to the piston portion. A movement portion of the piston may be slidably positionable in a piston cavity of the housing. The piston portion may be slidably engageable with a sliding surface of the piston. The housing portion may include an elongated body with a pointed tip at an end thereof. The fingers may have at least one inlet extending therein, and the packer seal may be extrudable about the at least one inlet. The fingers may have a variable gap therebetween. The packer seal may be extrudable about the fingers to form a seal with the housing and the piston. The packer seal may be molded about the fingers. The packer seal may have an inner surface convergable to form a seal with one of itself and a tubular of the wellbore.

In another aspect, the disclosure relates to a blowout preventer for sealing a wellbore penetrating a subsurface formation. The blowout preventer includes a housing having a flow path therethrough in fluid communication with the wellbore and a sealing assembly positionable in the housing about the flow path. The seal assembly includes a piston slidably positionable in the housing and a packer element. The piston has a hole therethrough in fluid communication with the fluid path. The packer element includes a plurality of fingers and a packer seal. Each of the fingers includes a housing portion and a piston portion. The housing portion is slidably movable along the housing and the piston portion slidingly movable along the piston. The fingers are engageable by the piston and movable to a sealed position about the flow path whereby the packer seal is selectively energizable to form a seal about the blowout preventer.

The housing may include a wellbore portion operatively connectable to a wellhead and a riser portion operatively connectable to a riser. The housing may include a riser portion, a wellbore portion, and a housing ring. The housing may have a cavity therein to receive at least a portion of the seal assembly. The housing may have a curved inner surface engageable by the housing portion. The housing may be positionable about a tubing of the wellbore. The blowout preventer may also include a pressure source to drive the piston. The seal assembly may be operatively connectable to a controller.

Finally, in another aspect, the disclosure relates to a method of forming a seal about a wellbore penetrating a subsurface formation. The method involves disposing a spherical blowout preventer about the wellbore. The blowout preventer includes a housing having a flow path therethrough in fluid communication with the wellbore and a sealing assembly positionable in the housing about the flow path. The sealing assembly includes a piston slidably positionable in the housing, and a packer element comprising a plurality of fingers and a packer seal. Each of the fingers includes a housing portion and a piston portion. The method also involves energizing the packer seal to forming a seal about the blowout preventer by slidingly engaging the piston portion of the fingers with the piston and moving the piston portion to a sealed position about the flow path.

The method may also involve retracting the packer seal to a retracted portion defining a desired diameter therein. The energizing may involve closing the flow path by compressing the packer seal with the fingers, supporting the packer seal by extending the piston portion towards the flow path a distance beyond an inner surface of the piston, converging tips of the housing portion of the fingers and/or tips of the piston portion of the fingers to define a reduced a diameter therebetween, supporting the packer seal in the sealed position by compressing the packer seal between the housing portion and the piston portion with the fingers, supporting the packer seal in an unsealed position by retracting the fingers, compressing the packer seal against an inner surface of the housing, compressing the packer seal between the piston portion and the piston, and/or self-sealing the packer seal by converging an inner surface of the packer seal together to close an inner diameter thereof.

The method may also involve disposing the tubular through the flow path, forming a seal about the blowout preventer by forming a seal about the tubular, and/or establishing fluid communication between a riser and the wellbore via the fluid path. The energizing may also involve slidably moving the housing portion along the housing and the piston portion along the piston, engaging the fingers with the piston, moving the fingers to a sealed position about the flow path, and/or moving the piston by selectively applying pressure to the piston. The disposing may involve operatively connecting a wellbore end of the housing to the wellbore and a riser end of the housing to a riser.

BRIEF DESCRIPTION DRAWINGS

So that the above recited features and advantages can be understood in detail, a more particular description, briefly summarized above, may be had by reference to the embodiments thereof that are illustrated in the appended drawings. It is to be noted, however, that the appended drawings illustrate examples and are, therefore, not to be considered limiting of its scope. The figures are not necessarily to scale and certain features and certain views of the figures may be shown exaggerated in scale or in schematic in the interest of clarity and conciseness.

DETAILED DESCRIPTION OF THE INVENTION

The description that follows includes exemplary apparatus, methods, techniques, and instruction sequences that embody techniques of the inventive subject matter. However, it is understood that the described embodiments may be practiced without these specific details.

The disclosure relates to a spherical blowout preventer (BOP) for forming a seal about a wellbore. The blowout preventer includes a housing to receive a tubular of the wellbore and a sealing assembly in the housing to form a seal. The packer seal may seal with the tubular, or be self-sealing when the tubular is absent. The sealing assembly includes a piston slidably positionable in the housing and a packer element.

The packer element includes fingers and a packer seal. The fingers may include a piston portion engageable by the piston and a housing portion slidably movable in the housing to a sealed position. The piston portion may be slidably movable along the piston in a manner intended to energize the packer seal, to provide support the packer seal during sealing, to prevent leakage between the packer seal and the piston, and/or to prevent wear of the packer seal along the piston.

Figure 1:
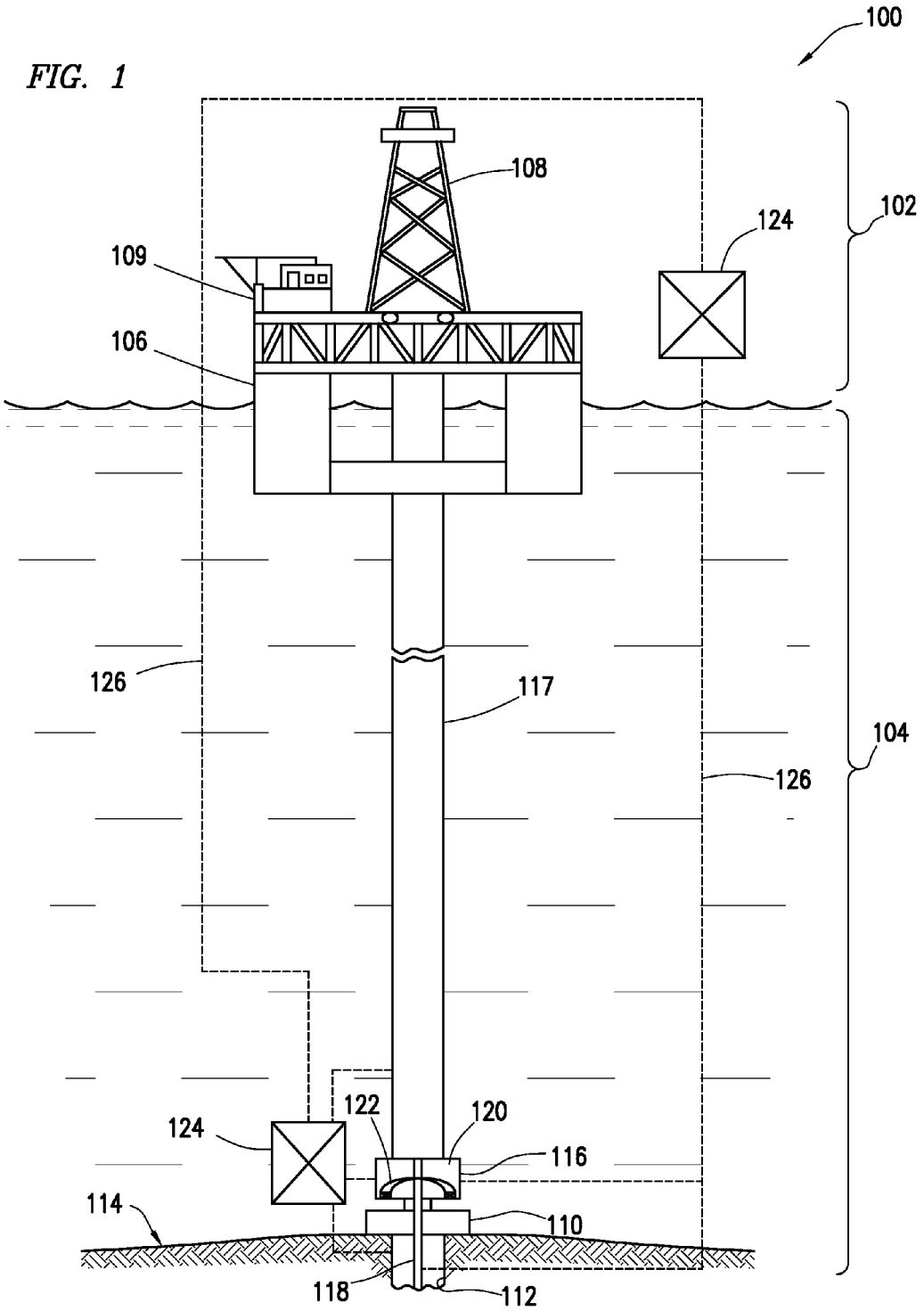
FIG. 1 is a schematic view of an offshore wellsite having a spherical blowout preventer (BOP) including a sealing assembly with an energizeable packer seal thereabout.

FIG. 1 depicts an environment in which the subject matter of the present disclosure may be utilized. An offshore wellsite 100 having surface equipment 102 and subsea equipment 104 is depicted. While the offshore wellsite 100 is depicted, the present disclosure may be used in connection with land-based or other applications.

The surface equipment includes a platform 106 with a rig 108 and a surface unit 109 thereon. The subsea equipment 104 includes a wellhead 110 extending from a wellbore 112 in seafloor 114, a spherical BOP 116 positionable about the wellhead 110, and a riser 117 extending from the wellbore 112 to the platform 106. The wellbore 112 has a tubing 118 extending from the wellhead 110 and through the BOP 116.

One or more various types of BOPs may be provided. In the example shown, the BOP 116 includes a housing 120 with a sealing assembly 122 therein for sealing about the wellbore 112. The sealing assembly 122 may include blades and/or seals to engage (e.g., sever, seal, bend, deform, rake) the tubing 118. The tubing 118 may be, for example, a pipe, downhole tool, coiled tubing, tool joint, and/or other tubular. In some cases, the sealing assembly 122 may be self-sealing, for example, to seal itself when tubing or another device is unavailable for sealing with the sealing assembly 122.

The surface system 109 may include and/or be operatively connectable to a controller 124. While a controller 124 is schematically depicted at a surface location, and another controller 124 is depicted in a subsea location, it will be appreciated that the one or more controllers 124 may be located at various locations about the wellsite 100 to operate the surface system 102 and/or the subsea system 104. Communication links 126 may be provided for communication between the controllers 124 and various parts of the wellsite 100.

Figure 2A:
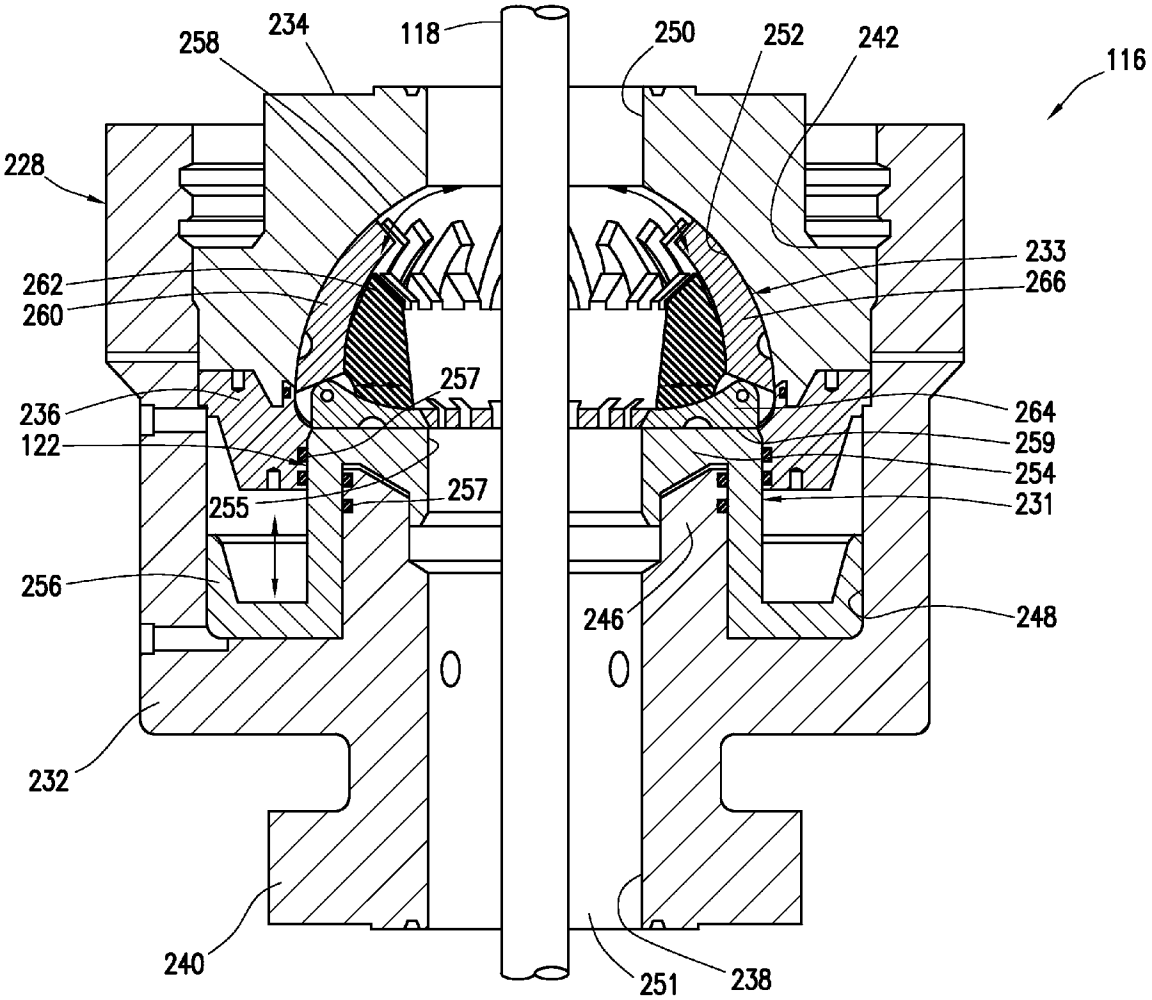
FIGS. 2A and 2B are cross-sectional views of the BOP with the sealing assembly in an unsealed and a sealed position, respectively.
Figure 2B:
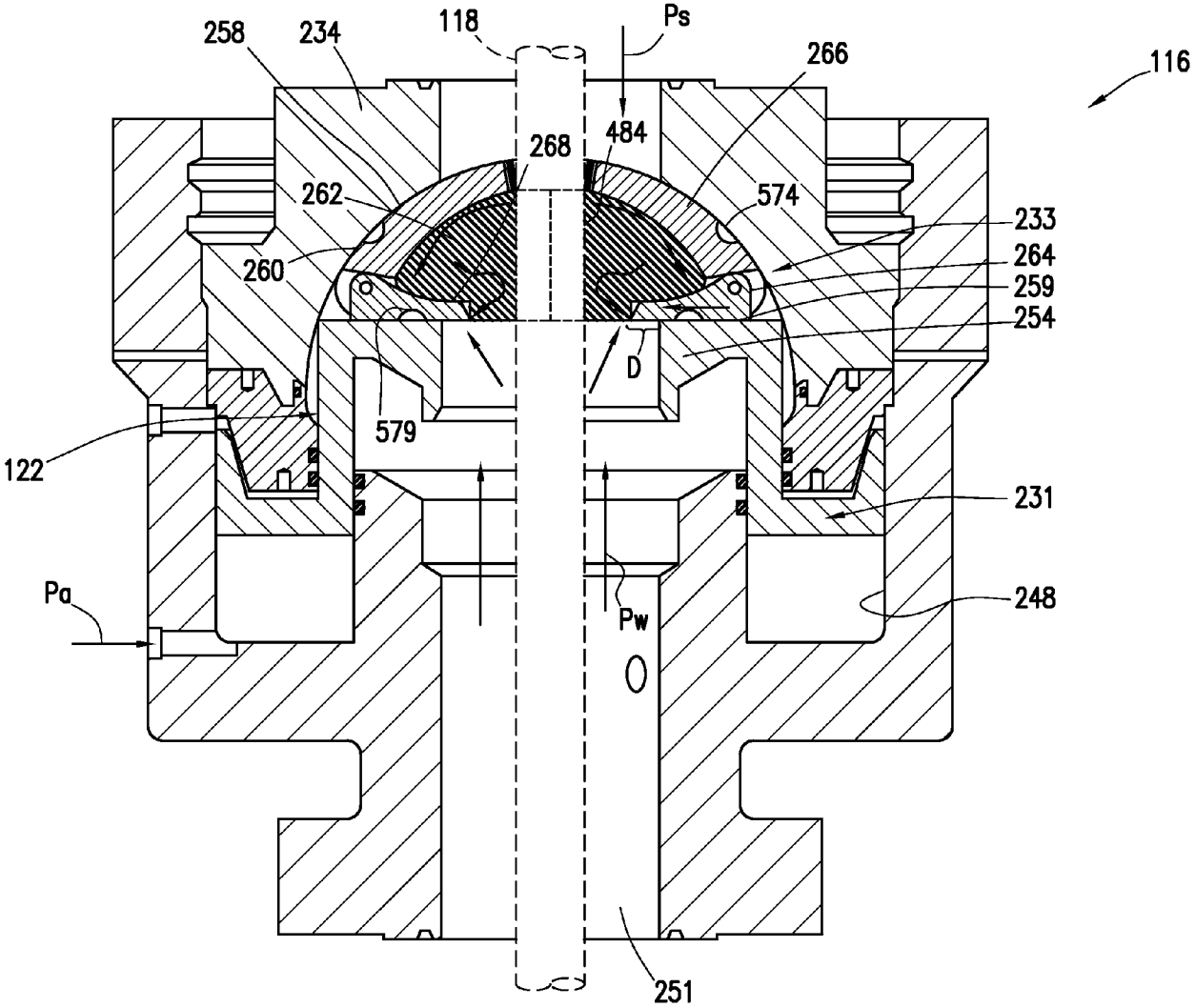
Figure 3A:
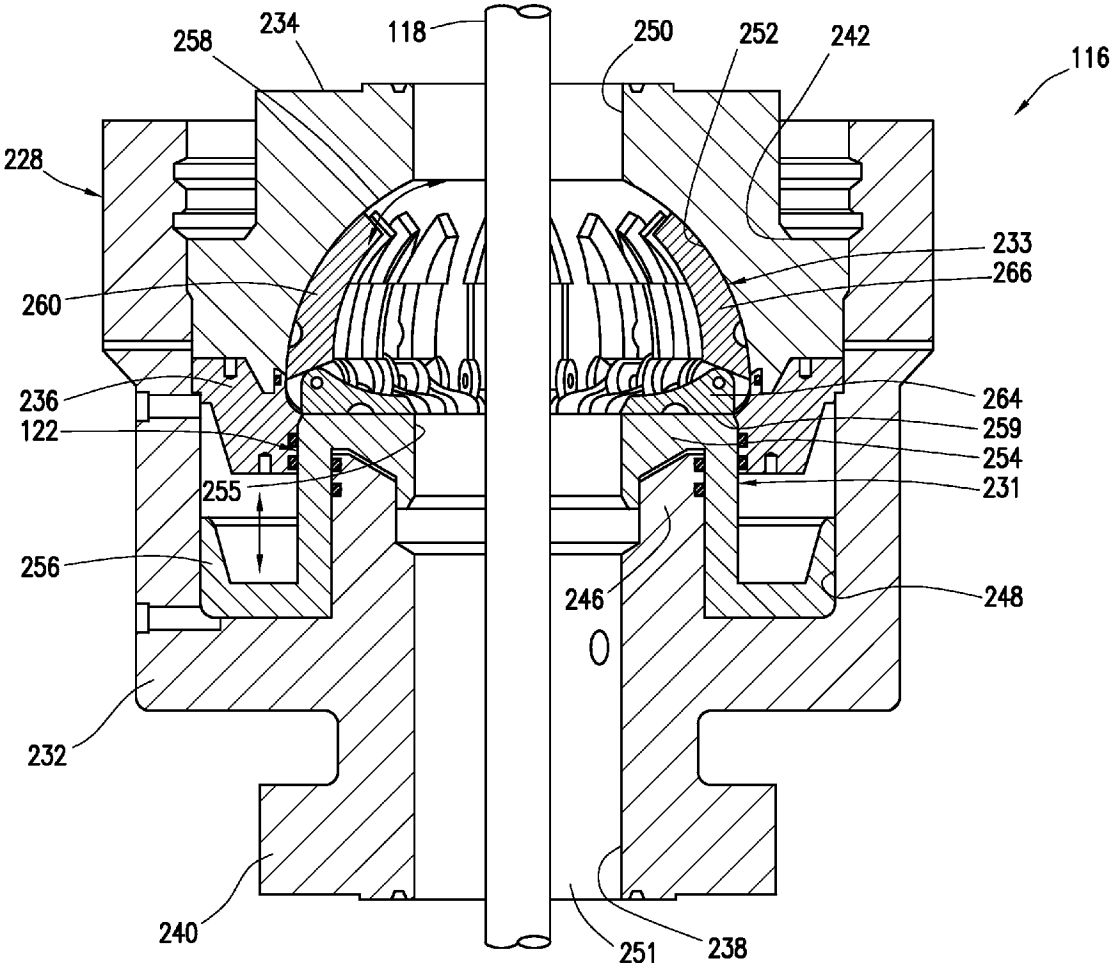
FIGS. 3A and 3B are cross-sectional views of the BOP of FIGS. 2A and 2B, respectively, with the packer seal removed.
Figure 3B:
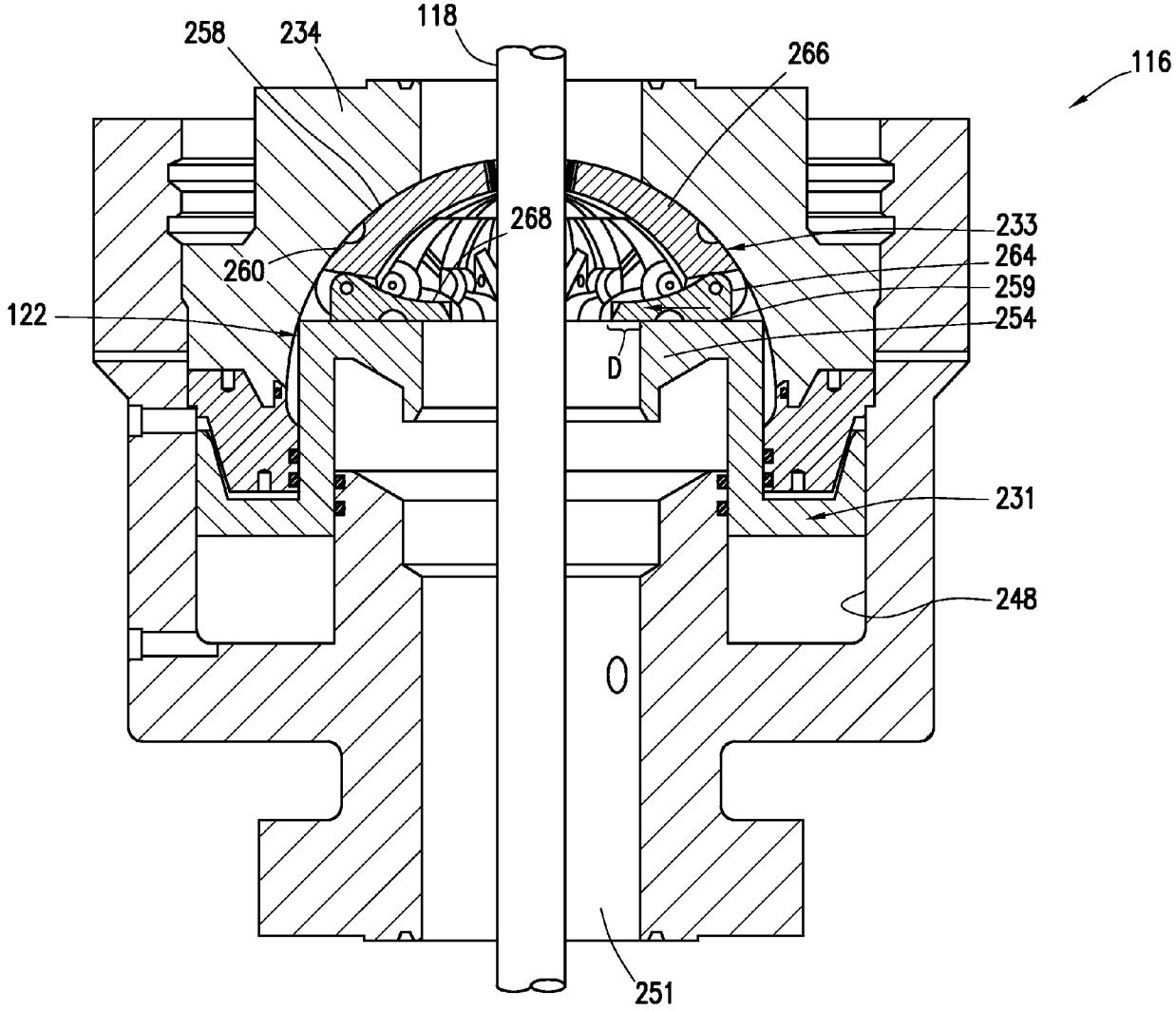

FIGS. 2A-3B depict an example version of the blowout preventer 116. FIG. 2A shows the blowout preventer 116 including a housing 228 with a sealing assembly 122 therein in an unsealed position. FIG. 2B shows the blowout preventer 116 with the sealing assembly 122 in a sealed position. FIGS. 3A and 3B show an alternate view of the BOP 116 with a seal of the sealing assembly 122 removed to depict operation thereof.

The sealing assembly 122 includes a piston 231 and a packer element 233. The housing 228 includes a wellbore portion 232 and a riser portion 234 with a housing ring 236 therebetween. The wellbore portion 232 has a body with a channel 238 to receive tubing 118 therethrough. A flange 240 extends from a seafloor end of the body and a housing cavity 242 extends into an opposite surface end. The flange 240 is operatively connectable to subsea equipment 104, such as wellhead 110 (FIG. 1). The housing cavity 242 is configured to receive the riser portion 234 and the housing ring 236 therein.

The wellbore portion 232 has a piston shoulder 246 extending from the wellbore portion 232 into the housing cavity 242 about channel 238. A piston cavity 248 is defined in the wellhead portion 232 between the housing ring 236 and the piston shoulder 246. The piston cavity 248 is shaped to receivingly engage a portion of the piston 231 of the sealing assembly 122. The housing ring 236 is supported in the wellbore portion 232 between the riser portion 234 and the piston 231.

The riser portion 234 is disposable in the housing cavity 242 with a portion extending from a surface end of the wellbore portion 232. An outer surface of the riser portion 234 is receivably supportable in the cavity 242 of the wellbore portion 232. The riser portion 234 has a body with a passage 250 in fluid communication with the channel 238 to define a flow path 251 through the BOP 116 for receiving the tubing 118 therethrough. The riser portion 234 has a cavity 252 with a curved inner surface 258 therein. The cavity 252 extends from the passage 250 and is configured to receive the packer element 233 therein.

A surface end of the riser portion 234 is operatively connectable to riser 117 and the flange 240 is operatively connectable to the wellbore 112 such that fluid may pass between the wellbore 112 and the platform 106. Fluid may flow between the tubular 118 and the riser 117 when the sealing assembly is in the unsealed position.

The sealing assembly 122 is movably positionable in the housing 228 to selectively seal the passage 250 therethrough. The piston 231 has an engagement portion 254 and a movement portion 256. The movement portion 256 is slidably positionable in the cavity 248 along curved surface 258 of the wellhead portion 232 of the housing 228 as indicated by the arrows. The engagement portion 254 has a tubular body extending from the movement portion 256 and a sliding surface 259 engageable with the packer element 233. The engagement portion 254 has a hole 255 therethrough forming part of the flow path 251.

The piston 231 is slidably movable in the cavity 248 along the wellbore portion 232. The piston 231 is also slidingly engageable with the housing ring 236. Gaskets 257 are provided about the piston 231 to form a seal. The gaskets 257 may be used, for example, to isolate hydraulic or other fluid in the cavity 248 and/or to prevent downhole fluid from passing between the piston and the housing ring 236 or the wellbore portion 232.

The packer element 233 includes fingers 260 and a packer seal 262. The fingers 260 include a piston portion 264 and a housing portion 266 pivotally connectable thereto. The piston portion 264 is slidably engageable with the sliding surface 259 of the piston 231 and radially movable about the housing 228 as indicated by the horizontal arrows. The housing portion 266 is slidingly movable along the curved surface 258 of the riser portion 234 as indicated by the curved arrows.

While the sliding surface 259 and the curved surface 258 are depicted in a specific orientation and configuration, it will be appreciated that these surfaces and the portions of the packer element 233 engageable therewith may be modified. For example, the sliding surface 259 is depicted as flat and horizontal, but could be angled and/or non-flat to slidably engage the piston portion 264. In another example, the housing portion 266 and the piston portion 264 are pivotally connected, and may be connectable by other means.

Upon activation of the piston 231, the piston portion 264 and the housing portion 266 move radially inward toward the tubular 118. The piston 231 may be activated by hydraulic, electrical, and/or other power. In an example, pressure may be provided into the cavity 248 to drive the piston 231 towards the riser portion 234. The piston 231 may drive the piston portion 264 to move along the sliding surface 266 and the housing portion 264 to move along the curved surface 258.

The packer seal 262 is disposed about the fingers 260 and energizable by movement of the sealing assembly 122. The packer seal 262 may be energized by movement of the fingers 262 towards the tubing 118 as shown in FIG. 2B. The housing portion 266 and the piston portion 264 advance and converge about the flow path 251 to support the packer seal 262 in a sealed position therein as shown in FIG. 2B. The packer seal 262 may expand to close the flow path 251 when in the sealed position. The packer seal 262 may be energized to seal the flow path 251 whether or not the tubing 118 is present or absent from the flow path 251.

As also shown in FIG. 2B, the BOP 116 may be subject to various forces and/or pressures. A wellbore pressure Pw may extend from the wellbore 106 into the flow path 251 as indicated by the upward arrow. In some cases, a surface pressure Ps may also apply to the BOP 116 as indicated by the downward arrow. An activation pressure Pa may be inserted into the piston cavity 248 to hydraulically activate movement of the piston 231 toward the sealed position.

Packer seal 262 is energized by movement of the fingers 260 to the sealed position of FIG. 2B. The housing portion 266 of the fingers 260 converges about flow path 251 to compress the packer seal 262 therebetween. The housing portion 266 supports the packer seal 262 against the curved surface 258 of the riser portion 234 to provide a seal thereabout to prevent leakage that may result, for example, from the surface pressure Ps. A portion of the packer seal 262 may be enclosed between the housing portions 266. A portion of the packer seal 262 may also extend between the fingers 260 and against the curved surface 258 to form a seal about the riser portion 234.

The piston portion 264 of the fingers 260 slide to a converged position along the sliding surface 259 of the piston 231. The piston portion 264 supports the packer seal 262 about the sliding surface 259 of the piston 231 to provide a seal thereabout to prevent leakage between the fingers 260 and piston 231 that may result, for example, from the wellbore pressure Pw.

When moved to the sealed position of FIG. 2B, the packer seal 262 may press towards the piston 231. As indicated by the curved arrows about the tip 268, the packer seal 262 may attempt to extend around the engagement portion 254 of the piston 231. The piston portion 264 may have a tip 268 that extends a distance D beyond an inner surface of the engagement portion 254 of the piston 231 along the flow path 251 to support the packer seal 262. Tips 268 of the piston portions 264 encircle the flow path 251 and define a sealing ring about the flow path 251 adjacent the piston 231. The tips 268 may support the packer seal 262 to prevent wellbore pressure Pw from acting on the piston 231 and/or to prevent fluid from passing between the packer assembly 233 and the piston 231.

Figure 4A:
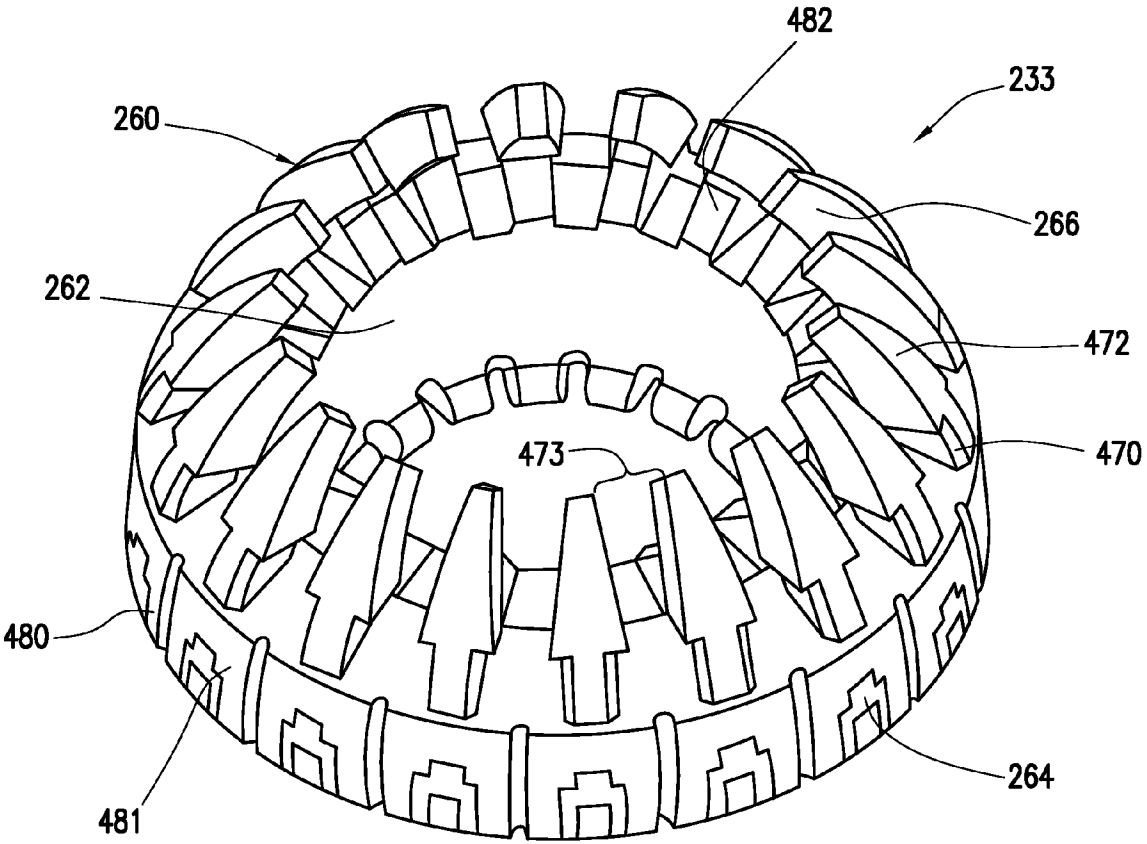
FIGS. 4A and 4B are perspective and cross-sectional views, respectively, of the sealing assembly of FIG. 2A.
Figure 4B:
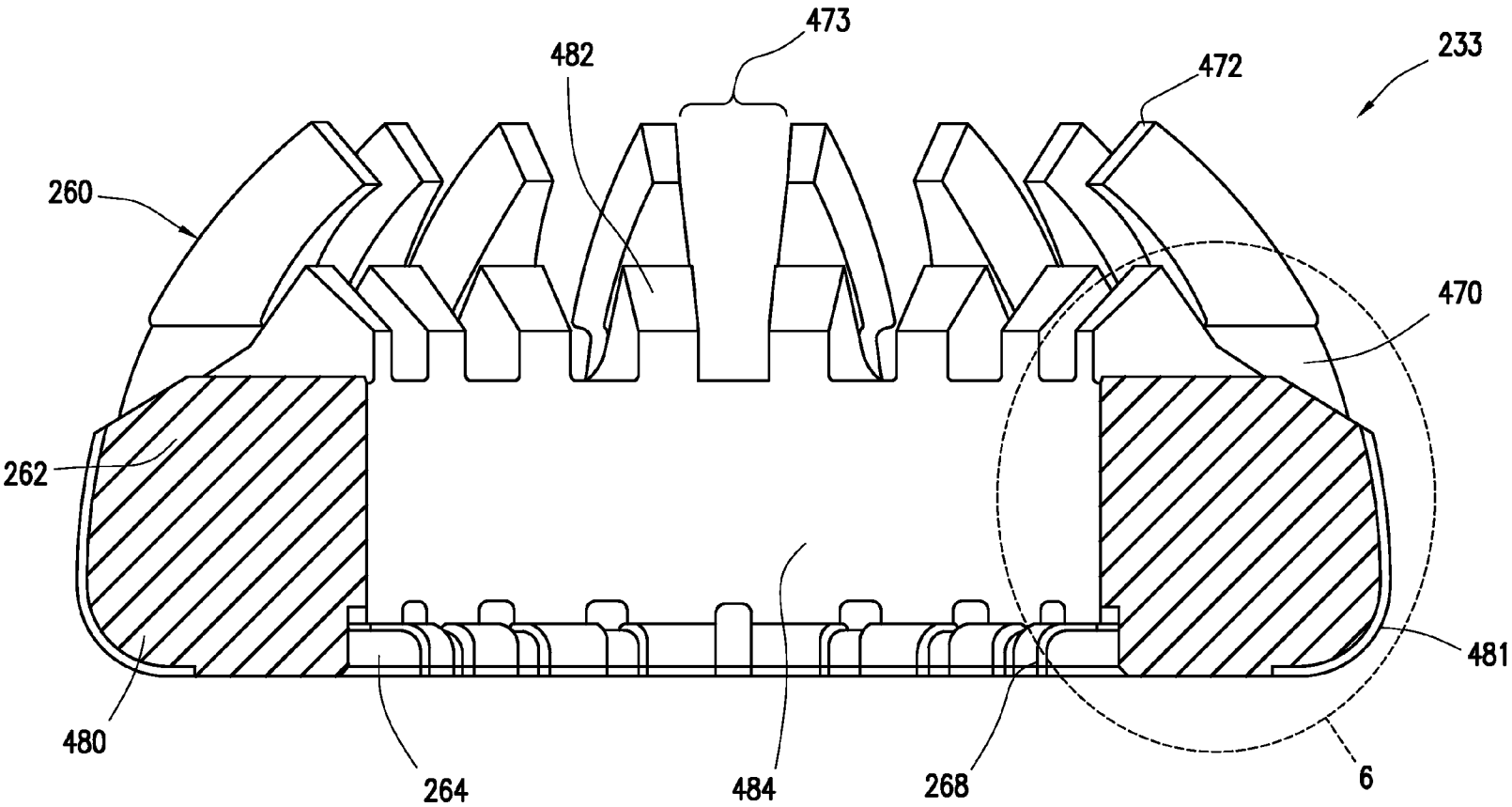
Figure 5:
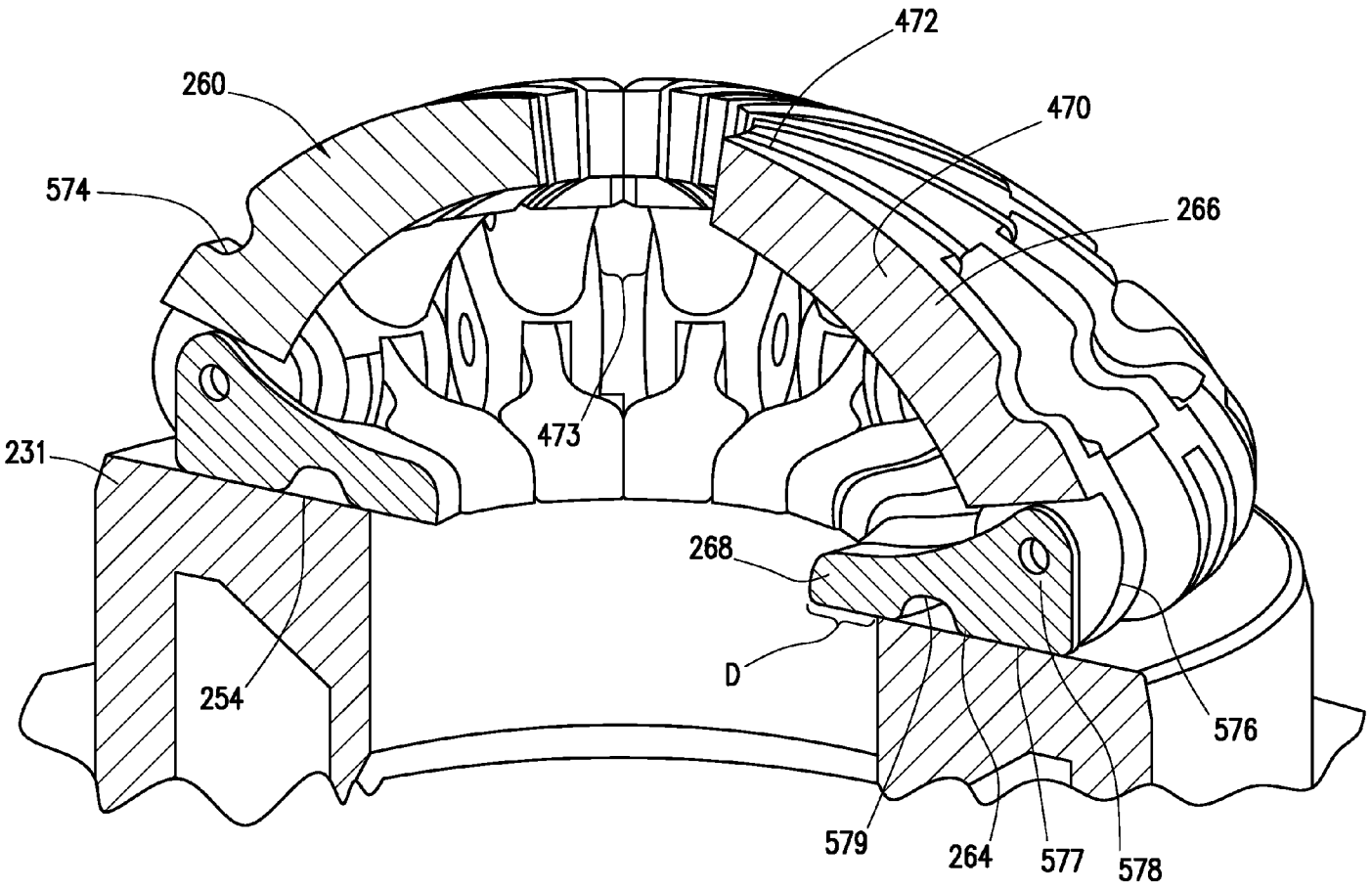
FIG. 5 is a cross-sectional view of the sealing assembly (without the packer seal) of FIG. 3B.

Referring to FIGS. 3A-5, various views depicting the operation and structure of the fingers 260 are provided. FIGS. 3A and 3B show the fingers 260 in the unsealed and sealed positions, respectively. FIGS. 4A and 4B show views of the packer element 233 removed from the BOP 116 with the fingers 260 in the unsealed position. FIG. 5 shows a portion of the packer element 233 adjacent piston 231 with the packer seal 262 removed therefrom.

As shown in FIGS. 4A-5, the housing portion 266 of the fingers 260 each have an elongated body 470 with a pointed (or tapered) tip 472 at a convergence end thereof. The tips 472 may optionally engage the tubular 118 to pierce, rake, sever, and/or otherwise cause damage to the tubular 118 to facilitate sealing about the BOP. A variable gap 473 is defined between the fingers 260. The elongated body 470 of the housing portion is pivotally connected to the piston portion 264 of the fingers 260.

As shown in FIG. 5, elongated body 470 has the curved outer surface with an inlet 574 extending therein. The elongated body 470 also has a rounded end 576 pivotable about the piston portion 264. The piston portion 264 has a pivot end 578 pivotally connectable to the rounded end 576 with the tip 268 extending therefrom. The tip 268 has a slider surface 577 engageable with the sliding surface 254 of piston 231. An inlet 579 extends into the slider surface 577. The gap 473, the inlet 574 of the housing portion, and the inlet 579 may provide for expansion of the packer seal 262 therein.

Figure 6:
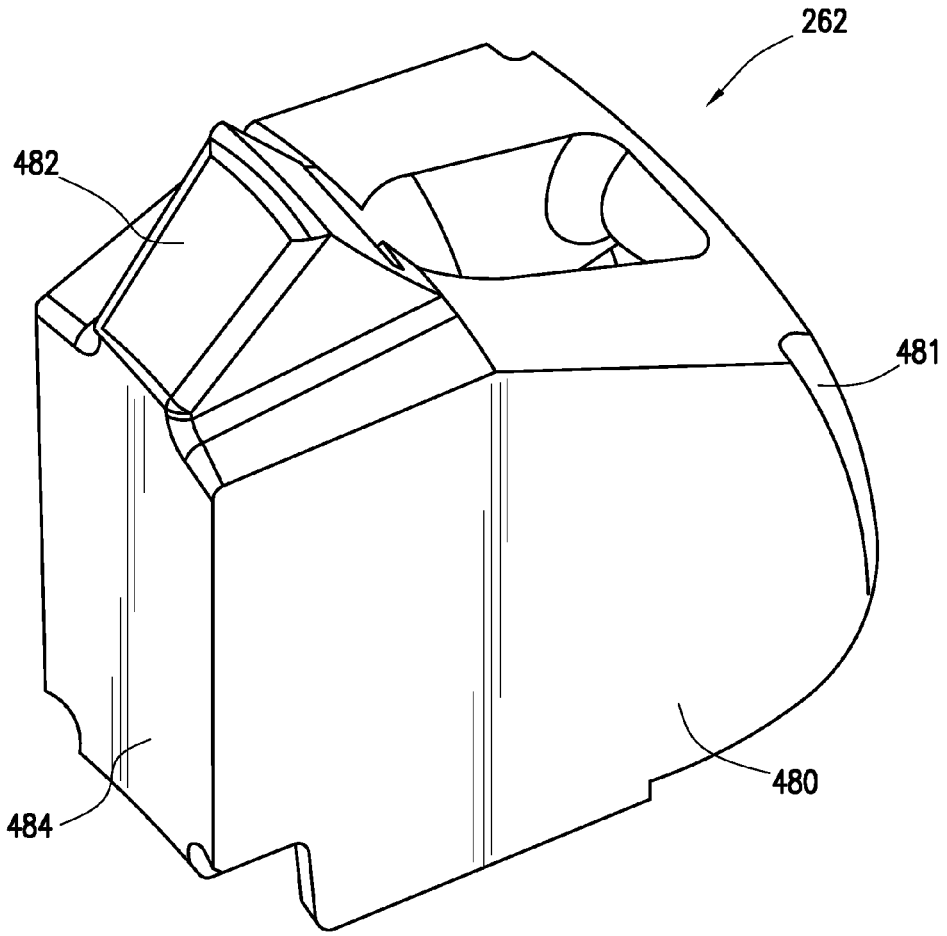
FIG. 6 is a perspective view of a portion 6 of the packer seal of FIG. 4B.

Referring to FIGS. 2A-2B, 4A-4B, and 6, various views depicting the operation and structure of the packer seal 262 are provided. FIGS. 2A and 2B show the packer seal 262 in the unsealed and sealed positions, respectively. FIGS. 4A and 4B show views of the packer element 233 removed from the BOP 116 with the packer seal 262 in the unsealed position. FIG. 6 shows a portion of the packer seal 262 with the finger 260 removed therefrom.

As shown in FIGS. 4A and 4B, in the unsealed (or uncompressed position), the packer seal 262 includes a ring shaped body 480 with fingers 260 embedded therein. The packer seal 262 may be molded about the fingers 260. The packer seal 262 may be compressible and/or energizable by movement of the fingers 260 as shown in FIGS. 2A and 2B. The packer seal 262 may be of an elastomeric (e.g., rubber) materials with a stiffness defined to provide desired sealing capabilities in the BOP 116.

The packer seal 262 has a curved outer surface 481 receivable in the housing 228 along the curved inner surface 258 of the riser portion 234 and/or the housing ring 236. As shown in FIGS. 4A, 4B and 6, the ring shaped body 480 terminates at vertical segments 482 adjacent the tips 472 of the fingers 260. An inner surface 484 of the packer seal 262 defines a path in fluid communication with flow path 251 for fluid flow therethrough when in the unsealed position.

As shown in FIG. 2B, the packer seal 262 is expandable about the fingers 260 to form seals with various portions of the BOP. The outer surface of the packer seal 262 extends between the fingers 260 to form a seal along the curved surface 258 of the riser portion 234. The inlets 574 in fingers 260 provide additional room for expansion between the fingers 260 for sealing. The packer seal 262 also expands between the housing portion 266 and the piston portion 264 and under the piston portions along inlets 579 to form a seal therebetween. The inner surface 484 of the packer seal 262 may be compressed together to close the flow path 251 to form a seal. The inner surface 484 may converge for self-sealing, or to seal with the tubular 118, if present.

In operation, the two-piece, hinged anti-extrusion configuration of the fingers 260 supports the packer seal 262 during sealing and works to prevent the packer seal 262 from extruding into a flow path 251 in the housing above and/or below the sealing assembly 233. As the piston 231 advances during sealing, the fingers 260 converge about the flow path 251 of the housing 228 and compresses the packer seal 262 to converge and seal the flow path 251. The seal may be formed by energizing the packer seal 262 to close an inner diameter therein, or to seal against the tubular 118 therein, if present.

The piston portion 264 of the fingers 260 slideably translates along a sliding surface 259 of the piston 231 such that the tip 268 of the piston portion 264 extends the distance D further into the flow path 251 than an inner surface of the piston 231. The piston portion 264 defines a variable diameter in the flow path 251 that is reduced during sealing. The diameter of the piston portion 264 is adjustable to a diameter smaller than a diameter of the hole 255 of the piston 231.

The piston portion 264 supports a wellbore end of the packer seal 262 and works to prevent the packer seal 262 from extruding into the hole 255 in the piston 231. The piston portion 264 acts to direct the packer seal 262 such that the seal converges to close an inner diameter of the packer seal 262. The configuration of the piston portion 264 supports the packer seal 262 as it converges above the piston 231 to prevent intrusion of wellbore pressure Wp beyond the piston 231. The piston portion 264 may be used to support the packer seal 262 to prevent the packer seal 262 from extending into the hole 255 of the piston and/or to prevent damage to the packer seal 262 as the packer seal 262 flows around the piston 231 and into the hole 252.

The size of the packer seal 262 may be provided to seal the flow path 251. The fingers 260 may be used to support the packer seal 262 towards the sealed position, thereby reducing the amount of material required to sufficiently seal the flow path 251. When the packer seal 262 is moved back to the unsealed position, the packer seal 262 may return to an original, retracted, and/or open position with a diameter therein.

Figure 7:
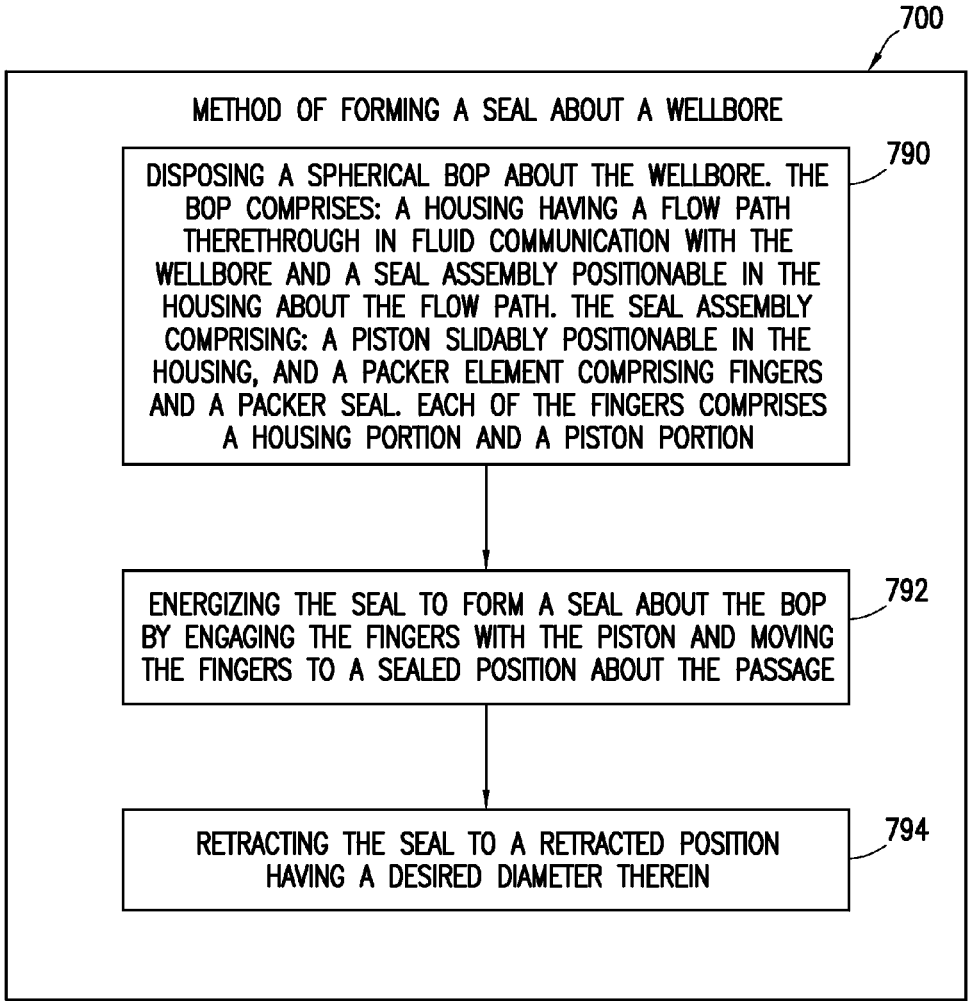
FIG. 7 is a flow chart depicting a method of forming a seal about a wellbore.

FIG. 7 is a flow chart depicting a method 700 of forming a seal about a wellbore (e.g., wellbore 112 of FIG. 1). The method 700 involves 790—disposing a spherical BOP about the wellbore. The BOP comprises a housing having a flow path therethrough in fluid communication with the wellbore and a sealing assembly positionable in the housing about the flow path. The sealing assembly includes a piston slidably positionable in the housing, and a packer element comprising a plurality of fingers and a packer seal. Each of the fingers includes a housing portion and a piston portion.

The method may also involve 792—energizing the packer seal to forming a seal about the BOP by slidingly engaging the piston portion of the fingers with the piston and moving the piston portion to a sealed position about the flow path, and 794—retracting the packer seal to a retracted position having a desired diameter therein.

The energizing may involve closing the flow path by compressing the packer seal with the fingers, supporting the packer seal by extending the piston portion towards the flow path a distance beyond an inner surface of the piston, converging tips of the housing portion of the fingers and/or tips of the piston portion of the fingers to define a reduced a diameter therebetween, supporting the packer seal in the sealed position by compressing the packer seal between the housing portion and the piston portion with the fingers, supporting the packer seal in an unsealed position by retracting the fingers, compressing the packer seal against an inner surface of the housing, compressing the packer seal between the piston portion and the piston, self-sealing the packer seal by converging an inner surface of the packer seal together to close an inner diameter thereof.

The method may also involve disposing the tubular through the flow path and the forming a seal about the blowout preventer by forming a seal about the tubular, and/or establishing fluid communication between a riser and the wellbore via the fluid path. The energizing may also involve slidably moving the housing portion along the housing and the piston portion along the piston, engaging the fingers with the piston and moving the fingers to a sealed position about the flow path, and/or moving the piston by selectively applying pressure to the piston. The disposing may involve operatively connecting a wellbore end of the housing to the wellbore and a riser end of the housing to a riser.

The method may also involve extruding the packer seal about the fingers to form a seal with the housing and the piston, energizing the packer seal to seal with a tubular in the BOP, and/or energizing the packer seal to converge to a self-sealing position. The methods may be performed in any order, and repeated as desired. Various configurations of the BOP and its parts may be used to perform the method.

It will be appreciated by those skilled in the art that the techniques disclosed herein can be implemented for automated/autonomous applications via software configured with algorithms to perform the desired functions. These aspects can be implemented by programming one or more suitable general-purpose computers having appropriate hardware. The programming may be accomplished through the use of one or more program storage devices readable by the processor(s) and encoding one or more programs of instructions executable by the computer for performing the operations described herein. The program storage device may take the form of, e.g., one or more floppy disks; a CD ROM or other optical disk; a read-only memory chip (ROM); and other forms of the kind well known in the art or subsequently developed. The program of instructions may be "object code," i.e., in binary form that is executable more-or-less directly by the computer; in "source code" that requires compilation or interpretation before execution; or in some intermediate form such as partially compiled code. The precise forms of the program storage device and of the encoding of instructions are immaterial here. Aspects of the subject matter may also be configured to perform the described functions (via appropriate hardware/software) solely on site and/or remotely controlled via an extended communication (e.g., wireless, internet, satellite, etc.) network.

While the embodiments are described with reference to various implementations and exploitations, it will be understood that these embodiments are illustrative and that the scope of the inventive subject matter is not limited to them. Many variations, modifications, additions and improvements are possible. For example, the sealing assembly, fingers, and/or seal may have a variety of shapes capable of sealing the wellbore.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A seal assembly of a blowout preventer for sealing a wellbore penetrating a subsurface formation, the blowout preventer comprising a housing with a fluid path therethrough in fluid communication with the wellbore, the seal assembly comprising:

a piston slidably positionable in the housing, the piston having a hole therethrough in fluid communication with the fluid path and further comprising a substantially planar portion that is substantially normal to a longitudinal axis of the seal assembly; and a packer element comprising a plurality of fingers and a packer seal, wherein each of the plurality of fingers comprises a housing portion and a piston portion comprising at least one substantially planar portion, wherein the housing portion is slidably movable along the housing and the at least one substantially planar portion of the piston portion is slidingly movable along the substantially planar portion of the piston, wherein the plurality of fingers are engageable by the piston to slidingly move (1) the piston portion of the plurality of fingers radially towards the fluid flow path through the housing of the blowout preventer and (2) the housing portion of the plurality of fingers along a curved surface of the housing to selectively energize the packer seal to form a fluid tight seal about the blowout preventer.

2. The seal assembly of claim 1, wherein the housing portion is pivotally connectable to the piston portion.

3. The seal assembly of claim 1, wherein a movement portion of the piston is slidably positionable in a piston cavity of the housing.

4. The seal assembly of claim 1, wherein the housing portion comprises an elongated body with a pointed tip at an end thereof.

5. The seal assembly of claim 1, wherein the plurality of fingers has at least one inlet extending therein, the packer seal extrudable about the at least one inlet.

6. The seal assembly of claim 1, wherein the plurality of fingers has a variable gap therebetween.

7. The seal assembly of claim 1, wherein the packer seal is extrudable about the plurality of fingers to form a seal with the housing and the piston.

8. The seal assembly of claim 1, wherein the packer seal is molded about the plurality of fingers.

9. The seal assembly of claim 1, wherein the packer seal has an inner surface convergable to form a seal irrespective of a tubular of the wellbore disposed in the fluid flow path.

10. A blowout preventer for sealing a wellbore penetrating a subsurface formation, the blowout preventer comprising:

a housing having a flow path therethrough in fluid communication with the wellbore; and a sealing assembly positionable in the housing about the flow path, the sealing assembly comprising:

a piston slidably positionable in the housing, the piston having a hole therethrough in fluid communication with the fluid path and further comprising a substantially planar portion that is substantially normal to a longitudinal axis of the seal assembly; and a packer element comprising a plurality of fingers and a packer seal, wherein each of the plurality of fingers comprises a housing portion and a piston portion comprising at least one substantially planar portion, wherein the housing portion is slidably movable along the housing and the at least one substantially planar portion of the piston portion is slidingly movable along the substantially planar portion of the piston, wherein the plurality of fingers are engageable by the piston to slidingly move (1) the piston portion of the plurality of fingers radially towards the fluid flow path through the housing of the blowout preventer and (2) the housing portion of the plurality of fingers along a curved surface of the housing to selectively energize the packer seal to form a fluid tight seal about the blowout preventer.

11. The blowout preventer of claim 10, wherein the housing comprises a wellbore portion operatively connectable to a wellhead and a riser portion operatively connectable to a riser.

12. The blowout preventer of claim 10, wherein the housing comprises a riser portion, a wellbore portion, and a housing ring.

13. The blowout preventer of claim 10, wherein a tubing of the wellbore is positionable through the flow path of the housing.

14. The blowout preventer of claim 10, further comprising a pressure source to drive the piston.

15. The blowout preventer of claim 10, wherein the seal assembly is operatively connectable to a controller.

16. The blowout preventer of claim 10, wherein the housing has a cavity therein to receive at least a portion of the seal assembly.

17. The blowout preventer of claim 10, wherein the housing has a curved inner surface engageable by the housing portion.

18. A method of forming a seal about a wellbore penetrating a subsurface formation, the system comprising:

disposing a spherical blowout preventer about the wellbore, the blowout preventer comprising: a housing having a flow path therethrough in fluid communication with the wellbore and a sealing assembly positionable in the housing about the flow path, the sealing assembly comprising: a piston slidably positionable in the housing, the piston comprising a substantially planar portion that is substantially normal to a longitudinal axis of the sealing assembly and a packer element comprising a plurality of fingers and a packer seal, wherein each of the plurality of fingers comprise a housing portion and a piston portion, the piston portion comprising at least one substantially planar portion; slidingly engaging the piston portion of the plurality of fingers with the piston;

slidingly moving (1) the piston portion of the plurality of fingers radially towards the fluid flow path through the housing of the blowout preventer with the at least one substantially planar portion of the piston portion slidingly moving along the substantially planar portion of the piston and (2) the housing portion of the plurality of fingers along a curved surface of the housing; and energizing the packer seal to form a fluid tight seal about the blowout preventer.

19. The method of claim 18, further comprising:

retracting the packer seal to a retracted position defining a desired diameter therein.

20. The method of claim 18, wherein the energizing comprises closing the flow path by compressing the packer seal with the plurality of fingers.

21. The method of claim 18, wherein the energizing comprises supporting the packer seal by extending the piston portion towards the flow path a distance beyond an inner surface of the piston.

22. The method of claim 18, wherein the energizing comprises converging one of tips of the housing portion of the plurality of fingers and tips of the piston portion of the plurality of fingers to define a reduced diameter therebetween.

23. The method of claim 18, wherein the energizing comprises supporting the packer seal in the sealed position by compressing the packer seal between the housing portion and the piston portion with the plurality of fingers.

24. The method of claim 18, wherein the energizing comprises supporting the packer seal in an unsealed position by retracting the plurality of fingers.

25. The method of claim 18, wherein the energizing comprises compressing the packer seal against an inner surface of the housing.

26. The method of claim 18, wherein the energizing comprises compressing the packer seal between the piston portion and the piston.

27. The method of claim 18, wherein the energizing comprises self-sealing the packer seal by converging an inner surface of the packer seal together to close an inner diameter thereof.

28. The method of claim 18, further comprising:

disposing a tubular of the wellbore through the flow path and wherein the forming the seal about the blowout preventer comprises forming the seal about the tubular.

29. The method of claim 18, further comprising establishing fluid communication between a riser and the wellbore via the fluid path.

30. The method of claim 18, wherein the energizing comprises engaging the plurality of fingers with the piston and moving the plurality of fingers to a sealed position about the flow path.

31. The method of claim 18, wherein the disposing comprises operatively connecting a wellbore end of the housing to the wellbore and a riser end of the housing to a riser.

32. The method of claim 18, wherein the energizing comprises moving the piston by selectively applying pressure to the piston.

* * * * *